United States Patent [19]

Isaka et al.

[11] Patent Number: 5,000,126

[45] Date of Patent: Mar. 19, 1991

[54] VERTICAL ENGINE FOR WALK-BEHIND LAWN MOWER

[75] Inventors: Yoshiharu Isaka; Kiyohiko Oguri, both of Iwata, Japan

[73] Assignee: Yamaha Kogyo Hatsudoki Kabushiki Kaisha, Iwata, Japan

[21] Appl. No.: 93,979

[22] Filed: Sep. 8, 1987

[30] Foreign Application Priority Data

Oct. 1, 1986 [JP] Japan ..... 61-235420
Oct. 1, 1986 [JP] Japan ..... 61-235421

[51] Int. Cl.[5] ..... F01P 7/04

[52] U.S. Cl. ..... 123/41.65; 123/65 VD; 123/195 HC; 56/10.1

[58] Field of Search ..... 123/195 HC, 196 W, 41.69, 123/41.65, 41.7, 41.41, 65 VD; 56/202, 12.2, 10.1, 320.1, 320.2

[56] References Cited

U.S. PATENT DOCUMENTS

| | | | |
|---|---|---|---|
| 3,091,226 | 5/1963 | Jepson | 123/41.7 |
| 3,183,899 | 5/1965 | Tuggle | 123/41.7 |
| 3,581,717 | 6/1971 | Fullerton | 123/41.69 |
| 3,841,278 | 10/1974 | Frehe | 123/41.69 |
| 4,149,362 | 4/1979 | Haffner et al. | 56/202 |
| 4,261,302 | 4/1981 | Sheldon | 123/41.56 |
| 4,326,370 | 4/1982 | Thorud | 56/202 |
| 4,433,651 | 2/1984 | Nakakita et al. | 123/193 H |
| 4,570,584 | 2/1986 | Uetsuji et al. | 123/195 HC |
| 4,570,587 | 2/1986 | Watanabe et al. | 123/195 C |
| 4,573,436 | 3/1986 | Owens | 123/41.18 |
| 4,688,529 | 8/1987 | Mitadera et al. | 123/196 R |
| 4,711,077 | 12/1987 | Kutsukake et al. | 56/320.2 |

FOREIGN PATENT DOCUMENTS

| | | | |
|---|---|---|---|
| 701578 | 1/1965 | Canada | 56/202 |
| 3338016 | 4/1984 | Fed. Rep. of Germany | 56/202 |

*Primary Examiner*—David A. Okonsky
*Attorney, Agent, or Firm*—Ernest A. Beutler

[57] ABSTRACT

A rotary lawn mower having an air-cooled single cylinder four-cycle internal combustion engine for powering its cutting blade. The engine is air cooled and is disposed so that its exhaust port lies above the intake port and the carburetor is positioned above a raised portion of the scroll part of the lawn mower housing for good cooling of the exhaust port without heating of the carburetor. A valve operating mechanism is disclosed including a pair of push rods that are supported on the exhaust port side of the engine and which are surrounded by a mass of cylinder head and cylinder for assisting in heat dissipation.

11 Claims, 6 Drawing Sheets

VERTICAL ENGINE FOR WALK-BEHIND LAWN MOWER

BACKGROUND OF THE INVENTION

This invention relates to a vertical engine for a walk-behind lawn mower and more particularly to an improved construction for air cooling an engine having its output shaft rotatable about a vertically extending axis.

Air-cooled engines find a wide variety of applications. One of the large volume applications for such engines is in powering certain implements such as walk-behind rotary lawn mowers. With such applications, the engine is normally positioned with the cylinder extending in a horizontal direction and with the output shaft rotating about a vertically extending axis. This has particular utility because it permits the engine output shaft to be directly coupled to the cutting blade, which rotates about a vertically extending axis, and thus affords a simple construction. However, there are a wide variety of difficulties in connection with the air cooling of an engine having such an orientation.

Specifically, one of the problems in cooling an engine of this configuration is that the air flow generally flows in a downward direction over the engine and specifically the cylinder barrel for its cooling. However, the immediately adjacent configuration of the lawn mower housing tends to obstruct such flow and may, in fact, redirect it so that the hot gases are directed across a portion of the engine which should be cooled or at least not heated. For example, it is very desirable to maintain the carburetor of the engine at a relatively low temperature so as to improve the induction efficiency and to preclude the evaporation of fuel from the heat of the engine.

It is, therefore, a principle object of this invention to provide an improved arrangement for air cooling the engine of a rotary lawn mower.

It is a further object of this invention to provide an improved layout for an engine and rotary lawn mower wherein the carburetor of the engine would not be unduly heated.

In addition to the problem of cooling the carburetor and preventing undue heating of it, it is also desirable to maintain the carburetor in relatively close proximity to the combustion chamber. Since the combustion chamber is one of the hottest portions of the engine, there is a tendency to attempt to position the carburetor at a remote distance from the cylinder head and combustion chamber so as to avoid the aforenoted heat problems. However, as the runner passage from the carburetor to the combustion chamber increases in length, starting, particularly at low temperatures, becomes difficult.

It is, therefore, a still further object of this invention to provide an improved arrangement for an engine wherein the carburetor may be positioned close to the combustion chamber.

It is a further object of this invention to provide an engine configuration wherein the carburetor will be cooled but nevertheless is in close proximity to the combustion chamber.

Utility engines employed for driving implements such as rotary lawn mowers have frequently used very simple engines having L-head construction. Although the simplicity of such engines have a number of advantages, the performance of these engines are considerably reduced from those of overhead valve engines. However, if a small overhead valve engine is employed and is utilized in conjunction with an implement such as a rotary lawn mower, certain difficulties arise in connection with the air cooling of the engine. For example, the positioning of the various components such as the exhaust manifold, muffler and air cleaner can, as aforenoted, present certain difficulties. It is, therefore, a further object of this invention to provide an improved air-cooling arrangement for the intake and exhaust valves of an air-cooled engine.

It is a further object of this invention to provide an improved air-cooling arrangement for an air-cooled overhead valve engine that operates with the cylinder disposed in a horizontal orientation.

Regarding the cooling of overhead valve internal combustion engines by air systems, it is normally the practice to operate valves by means of rocker arms that are pivotally supported within the cylinder head and are operated by means of push rods. However, it is important to ensure that the valve operating components are also adequately cooled.

It is yet a further object of this invention to provide an improved air-cooling arrangement for the push rods and valve actuators of an engine.

SUMMARY OF THE INVENTION

A first feature of this invention is adapted to be embodied in a lawn mower that is comprised of an outer housing which defines a scroll portion containing a cutting blade rotatable about a generally vertically extending axis. The scroll portion has an upper surface that is curved in a helical fashion from a low side close to the cutting blade to a raised position spaced vertically above the cutting blade and formed adjacent a discharged chute. An internal combustion engine is supported on the outer housing and has its output shaft rotatable about a generally vertically extending axis and which is rotatably coupled to the cutting blade for driving the cutting blade. The engine has at least one finned, horizontally extending cylinder. A cooling fan is driven by the upper end of the output shaft and is positioned vertically above the cylinder for directing cooling air downwardly across. The engine has an induction system that includes an inlet that is positioned vertically above the raised scroll portion.

Another feature of the invention is also adapted to be embodied in an internal combustion engine that has a cylinder, an exhaust valve for controlling the flow of exhaust gases from the combustion chamber of the cylinder and an intake valve for controlling the flow of an intake charge to the combustion chamber. Means are provided for operating the intake and exhaust valves which comprise members supported for movement along lines generally parallel to the axis of the cylinder and lying generally on one side of the cylinder. An exhaust port is formed in the cylinder and extends toward the one side of the cylinder from the exhaust valve to a muffler disposed on the one side of the cylinder. An intake port is formed in the cylinder and extends from the intake valve toward the opposite side of the cylinder to an inlet device that is disposed on the opposite side of the cylinder.

Yet another feature of the invention is adapted to be embodied in an air-cooled engine having a horizontally disposed cylinder. The engine has an exhaust valve for controlling the flow of exhaust gases from the combustion chamber, of the cylinder and an intake valve for controlling the flow of an intake charge into the combustion chamber. Means are provided for operating the intake and exhaust valves comprising members that are supported for movement along a plane generally parallel to the axis to the cylinder and lying on one side of the cylinder. In accordance with this feature of the invention, the exhaust valve controls the flow through an exhaust port that is formed in the cylinder and which extends from the exhaust valve to a muffler and which is positioned above an intake port that is formed in the cylinder and which extends from the intake valve to an intake device.

Yet another feature of the invention is also adapted to be embodied in an internal combustion engine having a horizontally exposed cylinder. The engine also has intake and exhaust valves that are operated by members that are supported by movement along a plane generally parallel to the axis of the cylinder and which lie generally on one side of the cylinder. In accordance with this feature of the invention, the means for operating the valves are enclosed within a chamber formed integrally with the cylinder for heat dissipation thereto.

DETAILED DESCRIPTION OF THE PREFERRED EMBODIMENT OF THE INVENTION

Figure 1:
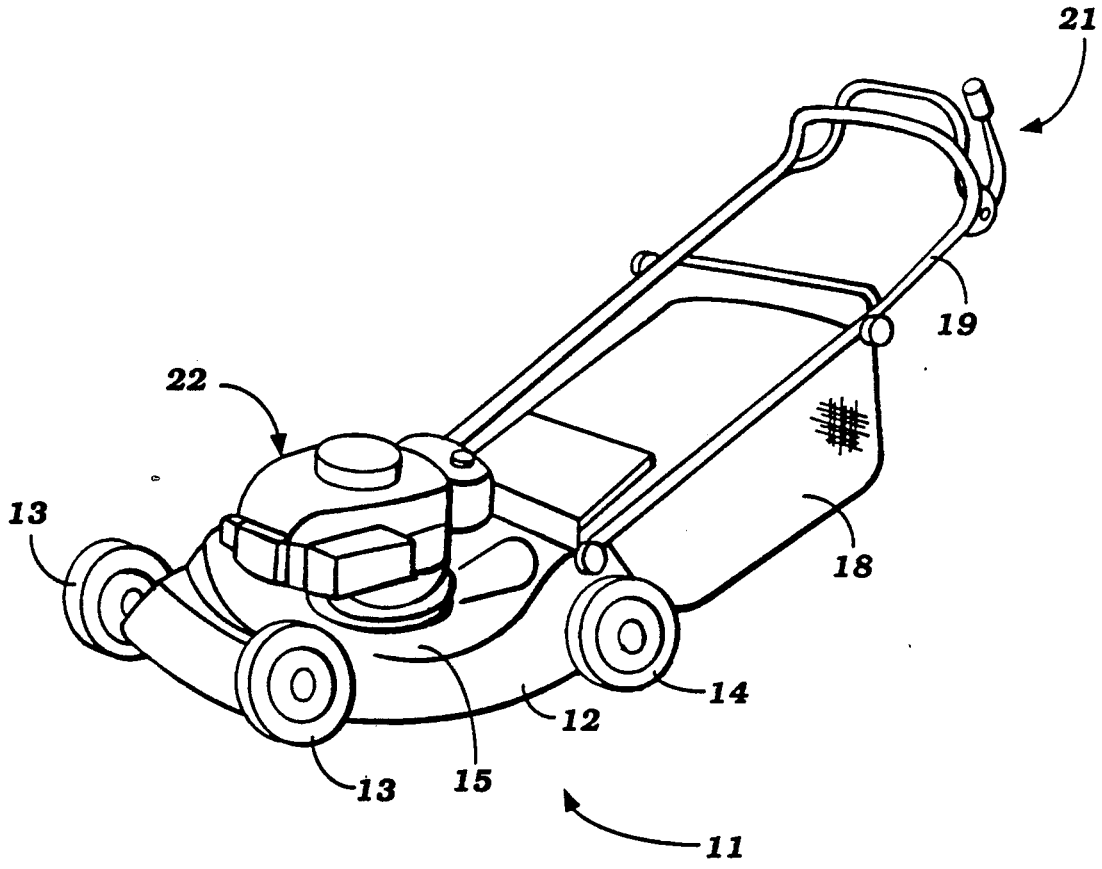
FIG. 1 is a perspective side view of a rotary lawn mower constructed in accordance with an embodiment of the invention and powered by an internal combustion engine constructed in accordance with an embodiment of the invention.
Figure 2:
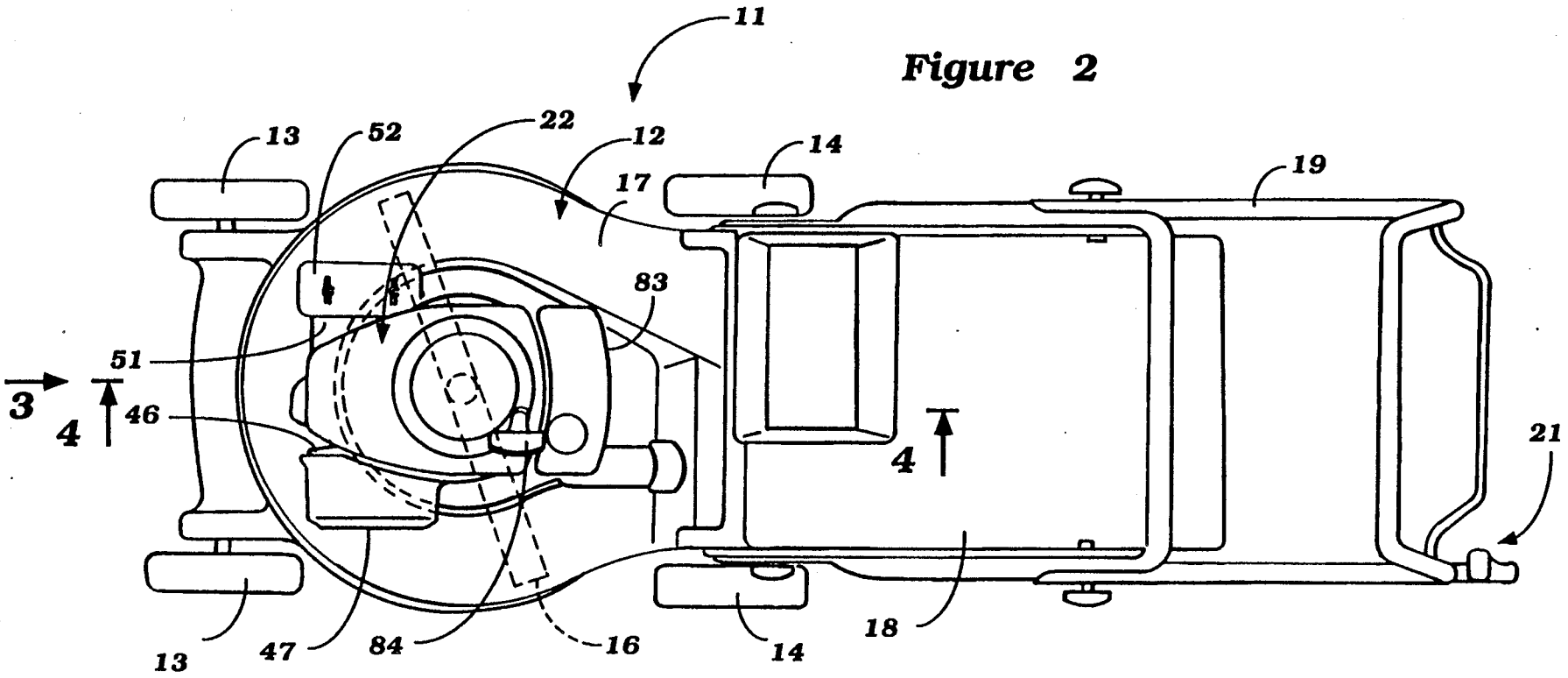
FIG. 2 is an enlarged top plan view of the lawn mower.
Figure 3:
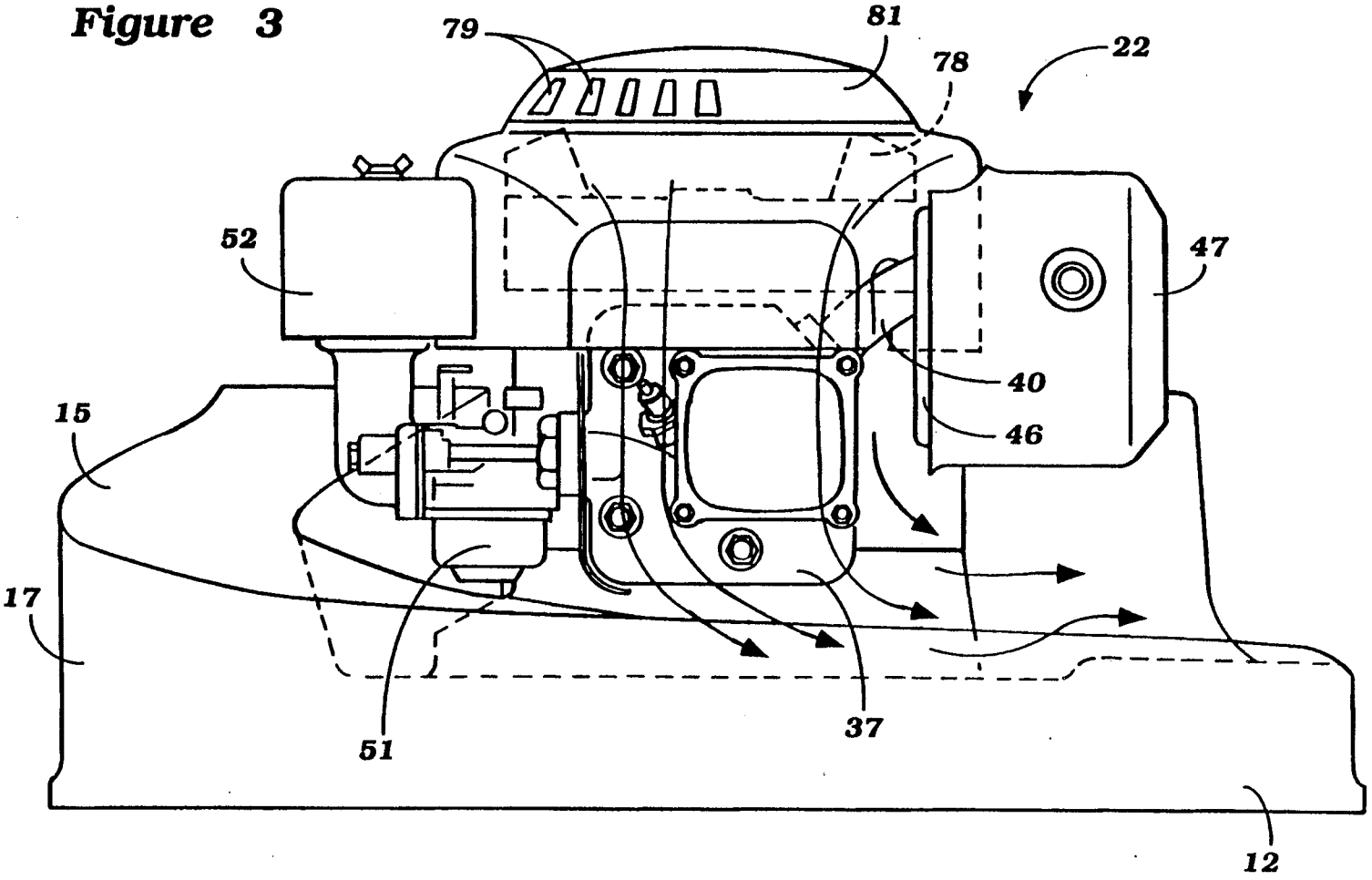
FIG. 3 is a further enlarged elevational view taken in the direction of the arrow 3 in FIG. 1.

Referring first primarily to FIGS. 1 and 2, a rotary walk-behind lawn mower constructed in accordance with an embodiment of the invention is identified generally by the reference numeral 11. Although certain features of the invention have particular utility in connection with such types of lawn mowers, other facets of the invention can be employed in other applications for internal combustion engines than rotary lawn mowers. However, the invention, as has been noted, has particularly utility in connection with rotary lawn mowers or in connection with implements that require an input shaft that rotates about a generally vertically extending axis, as is the case with a rotary lawn mower.

The lawn mower 11 includes an outer housing 12 that may be formed from any material such as a cast metal or the like and which is supported at its front end by front wheels 13 and at its rear end by rear wheels 14. If desired, the rear wheels 14 may be driven in an appropriate manner so as to provide a self-propelled lawn mower.

The housing 12 includes a scroll portion 15 that has an upper wall that is generally helical in configuration and which extends from a low portion that is disposed immediately adjacent the upper end of a cutting blade 16 to a raised discharge portion 17 which is disposed immediately adjacent a rearwardly facing discharge chute. A grass catcher bag 18 may be carried by the rear end of the mower so as to receive grass that is cut and thrown through this discharge chute. A handle 19 extends rearwardly from the main body portion 12 and overlies and supports the grass catcher bag 18 in a known manner. A throttle control 21 is carried by the rear portion of the handle 19 for controlling the speed of the mower.

Figure 4:
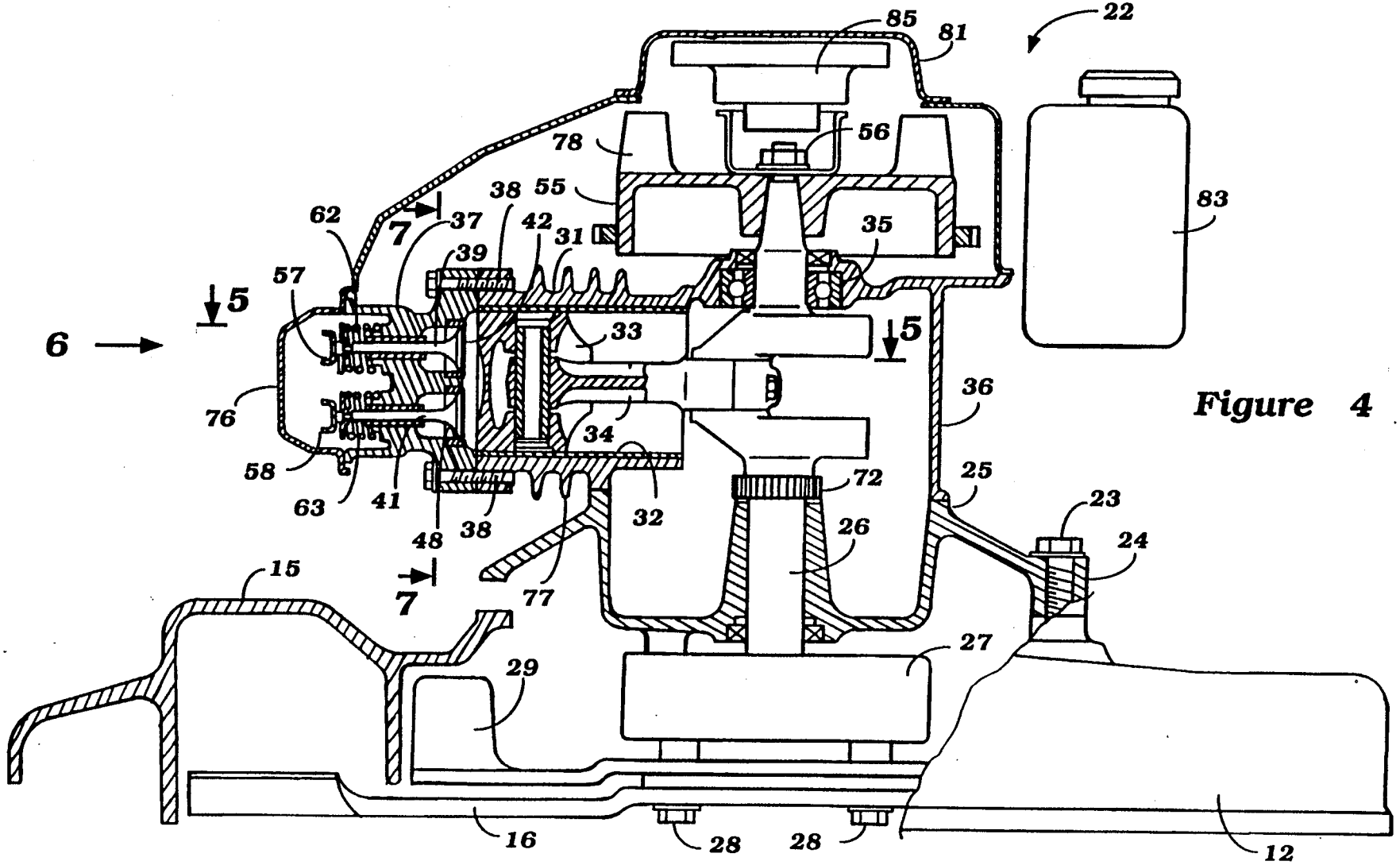
FIG. 4 is an enlarged cross-sectional view taken along the line 4—4 of FIG. 2.

An internal combustion engine, indicated generally by the reference numeral 22, is supported on the main housing 12 of the lawn mower 11 in an appropriate manner by means of mounting bolts 23 that extend through lugs 24 formed in a crankcase 25 of the engine 22 (FIG. 4). The mounting bolts 23 are threaded into cooperating openings in the housing 12 of the mower. As may be seen in FIG. 4, the engine 22 is of the single-cylinder, type and is disposed so that the engine crankshaft 26 rotates about a generally vertically extending axis. A coupling 27 is affixed to the lower end of the crankshaft 26 and is coupled by means of bolts 28 to the cutting blade 16 for driving it about a vertically extending axis. An impeller fan blade 29 may be affixed between the coupling 27 and the cutting blade 16 for generating an air flow through the scroll housing portion 15 so as to cause the grass to be raised and discharged through the discharge chute.

Figure 5:
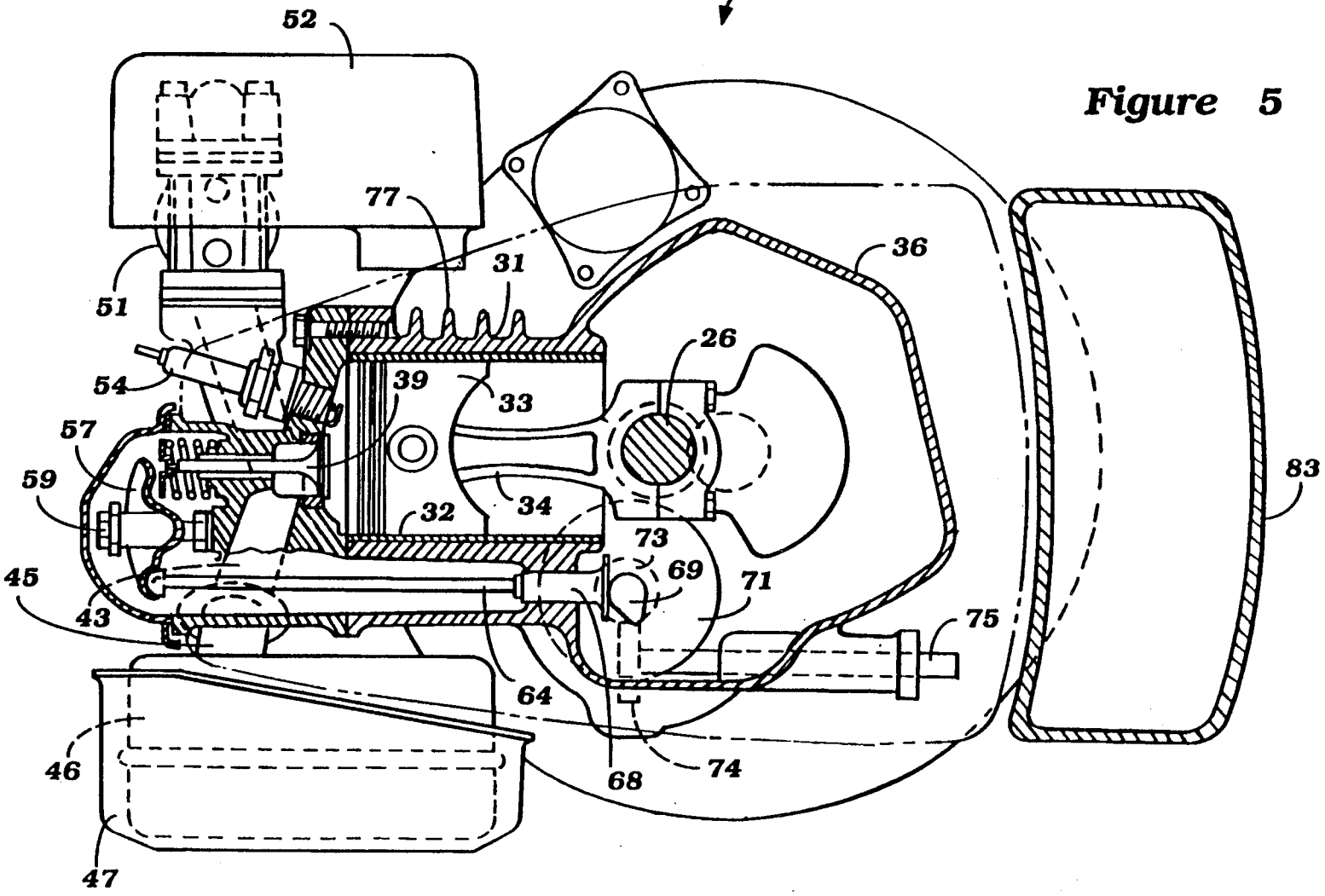
FIG. 5 is a cross-sectional view taken along the line 5—5 of FIG. 4.
Figure 6:
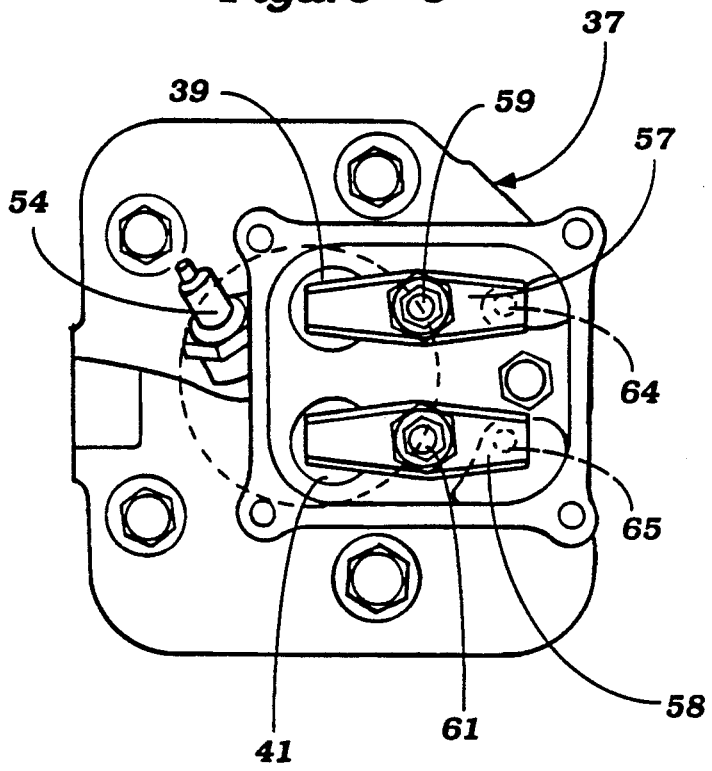
FIG. 6 is a top plan view of cylinder head assembly showing the valve operating mechanism with the valve cover removed and is taken generally in the direction of the arrow 6 in FIG. 4.
Figure 7:
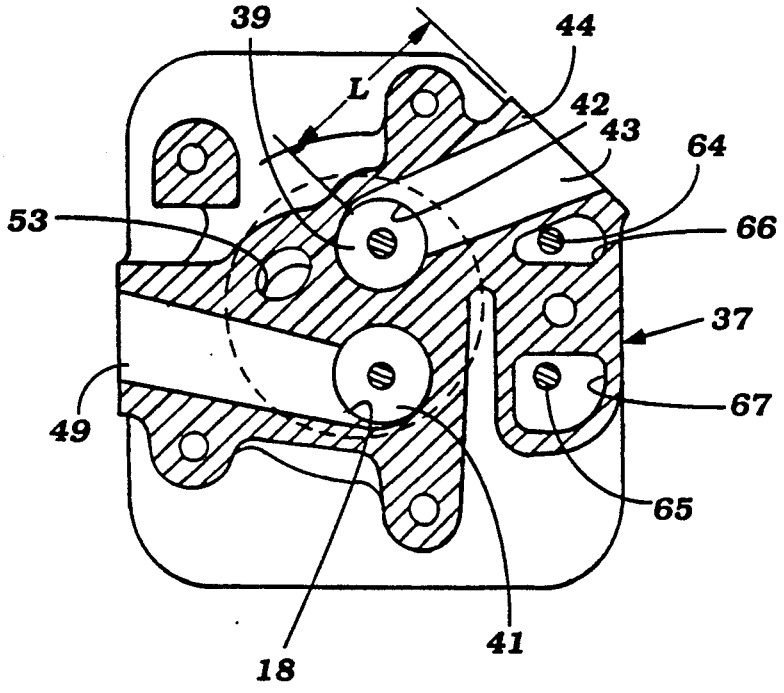
FIG. 7 is an enlarged cross-sectional view taken along the line 7—7 of FIG. 4.

Referring now primarily to FIGS. 3 through 7 and initially primarily to FIGS. 4 and 5, the engine 22 includes a cylinder barrel 31 that forms a single horizontally disposed cylinder bore 32. The cylinder bore 32 slidably supports a piston 33 that is connected by means of a connecting rod 34 to a throw of the crankshaft 26. The crankshaft 26 is rotatably journaled by means of an upper main bearing 35 in an upper crankcase portion 36 which is formed integrally with the cylinder barrel 31. The lower end of the crankshaft 26 is rotatably journaled in a plain bearing formed in the crankcase 25.

The cylinder head 37 is affixed to the cylinder block 31 in a known manner as by bolts 38. The cylinder head 37 is provided with a recessed area which cooperates with the head of the piston 34 and cylinder bore 32 to form the combustion chamber. An exhaust valve 39 is slidably supported within the cylinder head 37 by means of an appropriate valve guide and is positioned vertically above an intake valve 41 which is also supported by means of a valve guide in the cylinder head 37. The intake valve 41 and exhaust valve 39 are disposed generally in a vertical plane and lie at one side of the cylinder bore 32 as may be best seen in FIGS. 5 and 7.

The exhaust valve 39 cooperates with an exhaust valve seat 42 that defines a portion of an exhaust passage 43 that extends through the upper portion of the cylinder head 37 from the combustion chamber to a face 44 formed upwardly and at one side of the cylinder head 37. An exhaust pipe 45 cooperates with the cylinder head exhaust head passage 43 so as to deliver exhaust gases from the combustion chamber to a muffler 46 that is contained within a heat insulating baffle 47 formed at one side of the cylinder bore 32. It should be noted from FIG. 7 that the length of the cylinder head exhaust passage L is relatively short due to the location and configuration of the exhaust passage 43 so as to improve cooling and minimize the heat transferred to the cylinder head 37.

The intake valve 41 cooperates with a valve seat 48 that is pressed into the cylinder head 37 and which defines one end of an intake passage 49 that extends through the cylinder head 37 in a direction opposite to the direction of extent of exhaust passage 43 and which is positioned vertically beneath it. Like the exhaust passage, the intake passage 49 is relatively short so as to place it in close proximity to a carburetor 51 which is affixed directly to the cylinder head 37 and which delivers a fuel/air charge to the combustion chamber. An air cleaner 52 is affixed to the air horn of the carburetor 51 for delivering clean air to the carburetor.

It should be noted that the carburetor 51 is positioned on the opposite side of the engine from the muffler 46 so as to reduce the heat transfer between these two elements. In addition, the carburetor 51 is positioned above the raised portion of the scroll part 15 of the main body portion 12 of the mower adjacent the discharge chute so as to place it above the path of hot air, as will become apparent.

The cylinder head 37 is provided with a tapped hole 53 into which a spark plug 54 is threaded. The spark plug 54 is fired by means of a suitable ignition system which includes a magneto generator formed in part by means of a fly wheel 55 that is affixed to the upper end of the crankshaft 26 by means of a nut 56.

Exhaust and intake rocker arms 57 and 58 are supported for pivotal movement relative to the cylinder head by means of rocker arm pivots 59 and 61, respectively. The rocker arms 57 and 58 have one of their ends engaged with the stems of the valves 39 and 41, respectively. Coil compression springs 62 and 63 cooperate with keepers affixed to the valve stems for urging the valves 39 and 41 to their closed position.

Exhaust and intake push rods 64 and 65 extend through recesses 66 and 67, respectively, formed in one side of the cylinder head 37 and through a corresponding portion of the cylinder block 31. As a result, the push rods 64 and 65 are surrounded by a large mass of both the cylinder head 37 and cylinder block 31 so as to promote heat transfer and cooling.

The lower ends of the push rods 64 and 65 are engaged with tappets 68 that are slidably supported in the lower end of the cylinder block 31 and which tappets 68 cooperate with lobes 69 of a camshaft for opening and closing the valves 39 and 41 in a known manner. This camshaft has a timing gear 71 that is drivingly engaged with a timing gear 72 affixed to the crankshaft 26 for driving the camshaft at ½ crankshaft speed as is well known in this art.

The camshaft also carries a worm gear 73 that is enmeshed with a wormwheel 74 affixed to one end of an auxiliary output shaft 75 so as to permit driving of the rear lawn mower wheels 14 in the event self-propulsion is desired.

The cylinder head and specifically the rocker arms 57 and 58 and the valve mechanism is enclosed by a rocker arm cover 76 that is affixed in a suitable manner to the cylinder head 37.

The engine 22 is air cooled and to this end the cylinder barrel 31 is provided with cooling fins 77 which are formed integrally with it. The cylinder head 35 may also be appropriately finned, if desired. In order to drive cooling air across the engine, the fly wheel 55 is provided with a plurality of upwardly extending, integrally formed fan blades 78. The fan blades 78 cooperate to draw cooling air through atmospheric air inlet 79 formed in an upper portion 81 of a cover assembly. The cover assembly portion 81 is fixed to a main shroud portion 82 that extends across the main portion of the engine for directing the cooling air from the fan blades 78 and inlet opening 79 downwardly toward the mower main housing portion 12. The helical configuration of the upper surface of the scroll portion 15 causes this downwardly flowing air to turn as shown by the arrows in FIG. 3 and exit at a side of the mower 11. As has been noted, the carburetor 51 is positioned vertically upwardly because of its juxtaposition to the higher portion of the scroll portion 15 so that it will not receive any heated air from the engine. The muffler 46, on the other hand, is positioned at the upper portion of the engine as is the exhaust passage 43 so that these more highly heated parts will be cooled first and enjoy good cooling. Also, the push rods 64 are disposed at the side of the engine and they also will be effectively cooled. This cooling is assisted as is previously noted, by the mass of the cylinder block and cylinder head which encircles the push rod 64.

A fuel tank 83 is positioned rearwardly of the engine and is disposed so that it will not receive any significant amount of the heating cooling air.

The engine is provided with a pull starter including a starter handle 84 and starter mechanism 85 and this completes the engine construction.

It should be readily apparent from the foregoing description that the configuration and layout of the engine 22 and its cooperation with the mower housing 12 is such that the engine will be effectively cooled and this heat will be readily dissipated without heating the carburetor or fuel system of the engine. Also, the layout is such that the cooling will be very good and this affords a long life for the engine.

The foregoing description, as has already been noted, is that of a preferred embodiment of the invention and various modifications and changes may be made without departing from the spirit and scope of the invention as defined by the appended claims.

We claim:

1. A rotary lawn mower comprised of an outer housing defining a scroll portion containing a cutting blade rotatable about a generally vertically extending axis, said scroll portion having an upper surface curved in a helical fashion from a low side close to said cutting blade to a raised portion spaced vertically above said blade and formed adjacent a discharge chute, an internal combustion engine supported upon said outer housing and having its output shaft rotatable about a generally vertically extending axis and rotatably coupled to said cutting blade for driving said cutting blade, said engine having at least one finned horizontally extending cylinder assembly defining a cylinder bore and lying at least in part above said helical upper surface of said outer housing, a cooling fan driven by the upper end of said output shaft and positioned vertically above said cylinder assembly for directing cooling air downwardly across, an induction system for said engine including an inlet portion positioned vertically above said scroll raised portion.

2. A rotary lawn mower comprised of an outer housing as set forth in claim 1 wherein the inlet portion of the induction system comprises a carburetor and an air cleaner affixed to the carburetor.

3. A rotary lawn mower comprised of an outer housing as set forth in claim 2 further including an exhaust system for the engine disposed on the side of the cylinder assembly opposite to the carburetor.

4. A rotary lawn mower comprised of an outer housing as set forth in claim 3 wherein the muffler is positioned vertically above the adjacent surface of the scroll portion.

5. A rotary lawn mower comprised of an outer housing as set forth in claim 1 further including an exhaust valve for controlling the flow of exhaust gases from the combustion chamber of said cylinder assembly to the atmosphere, an intake valve for controlling the flow of an intake charge into said combustion chamber from said inlet portion, means for operating said intake valve and said exhaust valve comprising members supported for movement along a plane generally parallel to the axis of said cylinder assembly and lying on one side of said cylinder assembly, an exhaust port formed in said cylinder assembly and extending toward said one side of said cylinder assembly from said exhaust valve to a muffler disposed on said one side of said cylinder assembly, and an intake port formed in said cylinder assembly and extending from said intake valve toward the opposite side of said cylinder assembly to said inlet portion.

6. A rotary lawn mower comprised of an outer housing as set forth in claim 5 wherein the inlet portion comprises a carburetor and an air cleaner.

7. A rotary lawn mower comprised of an outer housing as set forth in claim 6 wherein the exhaust port is positioned vertically above the inlet port.

8. A rotary lawn mower comprised of an outer housing as set forth in claim 7 wherein the members for operating the intake and exhaust valve are contained within the cylinder assembly for promoting heat transfer therebetween.

9. A rotary lawn mower comprised of an outer housing as set forth in claim 8 wherein the cylinder assembly extends forwardly relative to the mower.

10. A rotary lawn mower comprised of an outer housing as set forth in claim 8 wherein the cylinder assembly includes a cylinder head closing one end of the cylinder bore, the intake and exhaust ports being formed in said cylinder head and the intake and exhaust valve being supported in said cylinder head.

11. A rotary lawn mower comprised of an outer housing as set forth in claim 10 wherein the cylinder assembly extends forwardly relative to the mower.

* * * * *